United States Patent [19]

Faure

[11] 3,972,152

[45] Aug. 3, 1976

[54] BAND-TYPE POLISHER

[76] Inventor: Robert Faure, c/o Cabinet Beau de Lomonie 14, Rue Raphail, 13 Marseille 8er, France

[22] Filed: Oct. 29, 1974

[21] Appl. No.: 518,763

[30] Foreign Application Priority Data

May 10, 1974 France ..... 74.17147

[52] U.S. Cl. ..... 51/141; 51/270

[51] Int. Cl.[2] ..... B24B 21/12

[58] Field of Search ..... 51/135 R, 135 BT, 141, 51/148, 270, 273

[56] References Cited

UNITED STATES PATENTS

| | | | |
|---|---|---|---|
| 1,124,311 | 1/1915 | Mattison | 51/141 |
| 1,820,377 | 8/1931 | Curtis | 51/141 |
| 1,844,165 | 2/1932 | Kabelac | 51/141 |
| 2,431,795 | 12/1947 | Elmes | 51/141 |
| 2,507,372 | 5/1950 | Emmons | 51/135 BT |
| 2,532,500 | 12/1950 | Jensen | 51/148 |
| 2,624,158 | 1/1953 | Hendrickson | 51/141 |
| 2,865,143 | 12/1958 | Goldsmith | 51/141 |
| 3,543,448 | 12/1970 | Schaller | 51/148 |

FOREIGN PATENTS OR APPLICATIONS

| | | | |
|---|---|---|---|
| 221,158 | 1/1959 | Australia | 51/270 |

*Primary Examiner*—Al Lawrence Smith
*Assistant Examiner*—Nicholas P. Godici
*Attorney, Agent, or Firm*—Harness, Dickey & Pierce

[57] ABSTRACT

The present invention concerns an abrasive band-type polisher having a plurality of contact wheels with differing profiles carried on arms which are rotatable to bring respective ones of said contoured contact wheels into engagement with the band to cause the band to assume the profile of the contact wheel. Special provision is made to allow polishing of workpieces without engagement thereof with the structural portions of the polisher, to facilitate accurate tracking of the band during polishing, and to facilitate the substitution of contact wheels.

14 Claims, 5 Drawing Figures

BAND-TYPE POLISHER

BACKGROUND AND SUMMARY OF THE INVENTION

This invention relates to machines for polishing metals which comprise an abrasive band running about a pair of wheels. One wheel is generally driven by an electric motor and another is set at a height such that the operator may present the object to be polished to a part of the band.

Prior art polishing machines are not entirely satisfactory because the wheel on which the object is polished is obstructed at one of its sides by the drive motor and also by the protective housing surrounding the band and part of the wheel, thereby limiting the orientation of the object during the polishing operation. Furthermore, the object to be polished is presented to the curved part of the band, whose abrasive grains at that part are momentarily spaced apart. This local deformation is accentuated, because of the tensioning of the band and its speed, the grains closing up when the band becomes rectilinear again.

Another inconvenience inherent in these arrangements resides in the fact that the part of the band to which the object is presented is deformed not only in the longitudinal direction, but also in the transverse direction, and particularly when the object to be polished is put into contact with the lateral edges of the band. With this double deformation, the bands generally retain their strength only with difficulty. Furthermore, the momentary spacing of the grains of abrasive at the precise place where the object to be polished is presented tends during the course of the polishing to clog or fill up the band, which results in poor performance of the machine, and even to scratch the polished object if the band is not changed before the clogging of it becomes too great. Moreover, such machines are expensive in use.

The present invention remedies these inconveniences.

This remedy is achieved in a band-type polisher which permits operating the objects to be polished without their coming into contact with the structural parts of the machine during polishing, and which permits prolonged use of the band for better efficiency of the machines, this efficiency being in particular increased by the aid of means for giving the band the contours necessary for doing the polishing of objects in various local operations, each of these operations requiring only one pass on the band.

This remedy is further achieved according to the invention by providing a band-type polisher which comprises a drive wheel splined on the shaft of the drive motor, and which comprises a driven wheel mounted to rotate freely on a support connected to the structure of the polisher, this being characterized in that the said support forms a working head of a width substantially equal to that of the band, which working head is quite unobstructed on either side in order to not impair the orientation of the object being polished during the polishing operation.

Another novel characteristic of the polisher according to the present invention resides in the fact that it comprises a rotatable member mounted rotatably about an axle and so as to be able to turn in a plane going approximately through the longitudinal axis of the band and disposed so as to be able to turn between the pulleys and the lengths of the band between the pulleys, the rotatable member carrying at least one contact wheel mounted freely rotatably so that it can be driven momentarily by the belt, and provided with means to immobilize it so that the said contact wheel may be near the said driven wheel and also perpendicular of and substantially in the longitudinal axis of the band. The polisher further has means to apply the said contact wheel against the nonabrasive face of the band.

Another novel characteristic of the polisher according to the present invention resides in the polishing operation in which the object to be polished is placed into contact with the taut drive length of the band thus forming a plane surface.

The principal advantage of such a machine and of the process using the machine is that the polishing is done by putting the object to be polished into contact with the plane part of the band, whose abrasive grains are pressed closely together. Another advantage of the invention is inherent because of the fact that considering this arrangement, the band may be deformed without being deteriorated, this deformation being along its transverse direction.

The object to be polished is, therefore, put into contact with the band, this latter assuming the profile of the contact wheel against which it rests, so as to polish in one operation one part of the object. A set of a number of contact wheels having different profiles facilitates the operation and permits a considerable savings of time.

Other advantages and characteristics of the invention will be apparent from reading the following description of an exemplary example, and from the annexed drawings:

DETAILED DESCRIPTION OF THE PREFERRED EMBODIMENT

Figures 1, 2, 3:
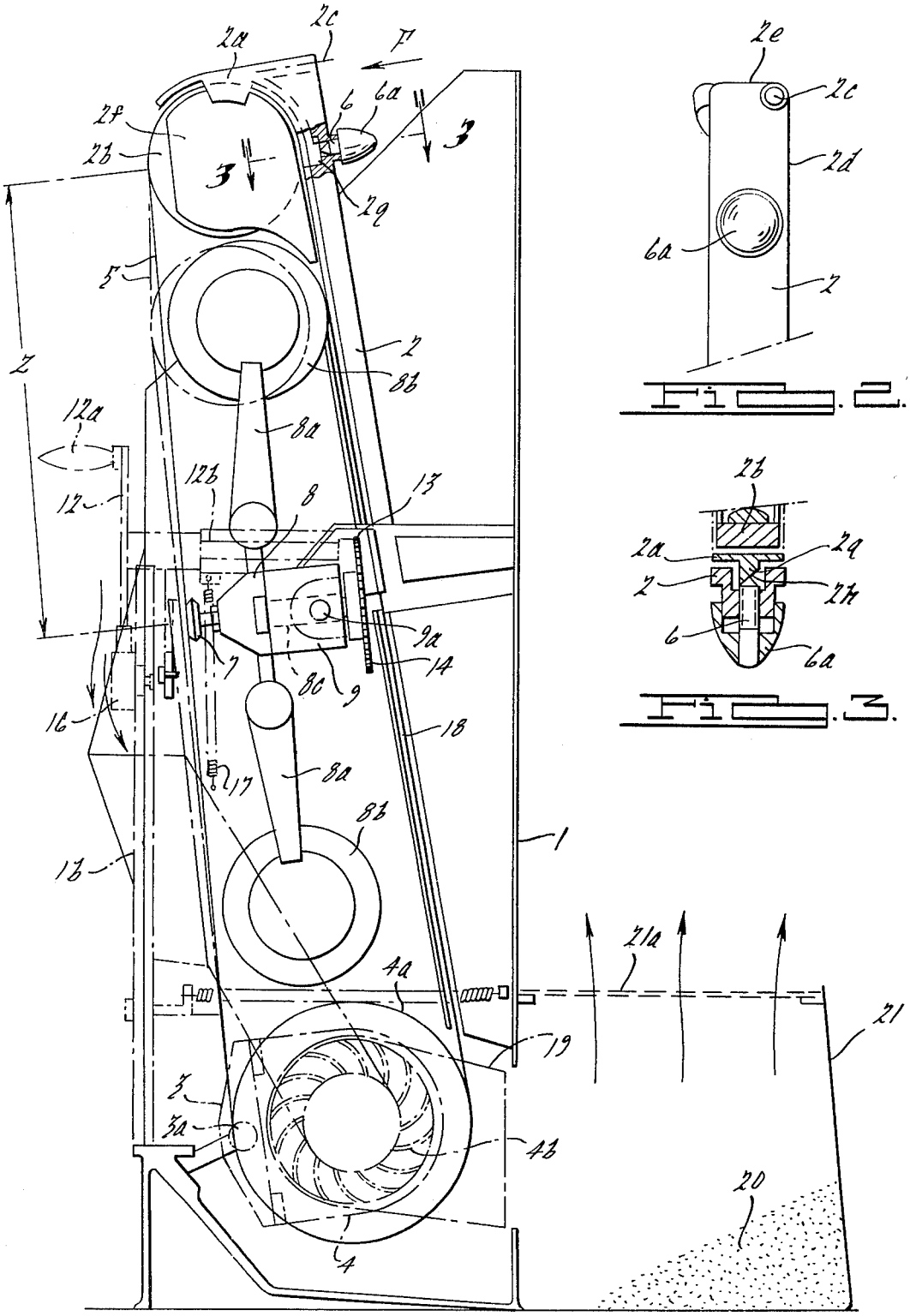
FIG. 1 is a schematic sectioned view of a band-type polisher according to the present invention.
FIG. 2 is a partial view looking in direction F of the work-head of a band-type polisher.
FIG. 3 is a partial section along line III—III of the said work-head.
Figure 4:
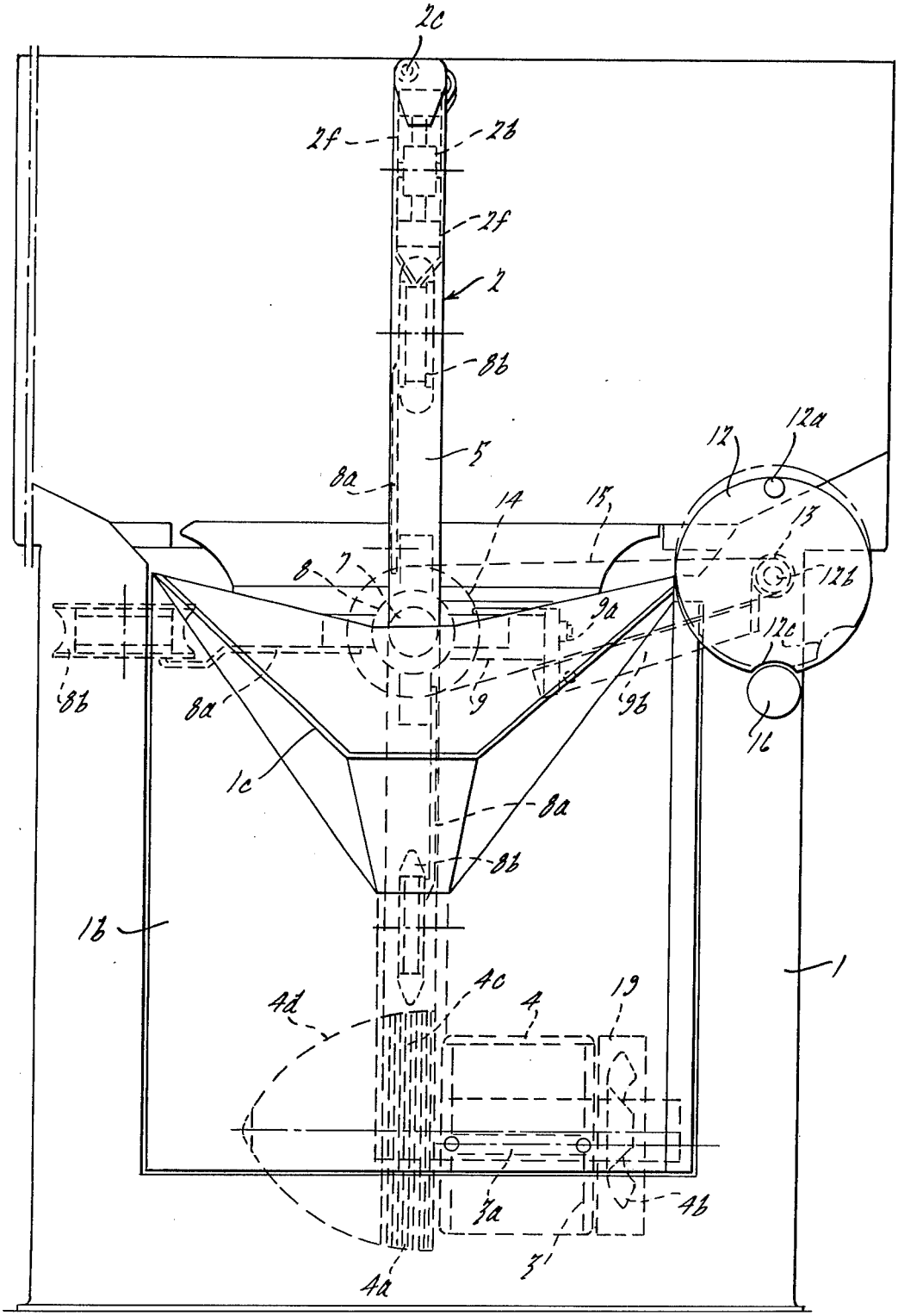
FIG. 4 is a front elevation of a band-type polisher.

With reference now to FIGS. 1 and 4, a polisher according to the invention is shown as composed of a structure 1, comprising a work-head 2. The work-head 2 slants slightly toward the front of the machine, and carries, freely rotatable on an oscillating support 2*a*, a wheel 2*b*, termed hereinafter as the "driven wheel".

An electric motor 4 is disposed at the bottom of the polisher on a support 3 which is articulated to the structure 1 round an axle 3*a*. A vaned wheel 4*b* is splined to the shaft at one of its ends. An abrasive band 5, which is run round the two pulleys 2*b* and 4*a*, is tautened under the action of the pulley 4*a* carried by the motor 4. The pulley 2*b* is covered with an elastomer, and is of the type generally used in known polishers, its peripheral face being flat and its edges slightly rounded. The pulley 4*a* has longitudinal grooves 4*c*.

The width of the work-head 2 is approximately equal to that of the band 5. The oscillating support 2*a* is mounted so that it is able to pivot about an axle 2*c*

(FIG. 2), which is offset relatively to the longitudinal axis of the work-head 2, so as to be simultaneously tangent to the lateral face 2*d* and to the end 2*e* of the latter. The wheel 2*b* is carried by the oscillating support 2*a*, which comprises two lateral protective webs 2*f*, integrated with the work-head so that no constituent part of the machine may obstruct, at either side of the said head, the orientation of the object to be polished.

The oscillating support 2*a* comprises, at the rear side of the polisher, a boss 2*g* having an inclined face 2*h*.

Against this face is applied a pointed element 6, which is threaded into the work-head 2 and is operated by a knurled knob 6*a*. The action of the pointed element 6 on the inclined face 2*h* of the boss 2*g* has the effect of causing the support 2*a* to pivot round the axle 2*c*.

This arrangement permits centering the band 5 when imperfections thereof tend to make it become displaced toward one of the side edges of the said work-head 2 while being driven.

The object to be polished is presented to the band 5 within a zone Z extending from the wheel 2*b* to a support point 7 whose contact face is tangent to the rectilinear part or "driving length" of the band and which is slightly convex in the form of a spherical cap. Although it is possible to polish the object by putting it into contact with the part of the band 5 running round the wheel 2*b*, the preferred part of the band to work with is in the zone Z. Working in the zone Z saves the band from any deterioration due to the fact that it has been observed that it is not possible to deform a band except along either the longitudinal direction or the transverse direction, but not both at the same time.

On the axis of the work-head 2, and substantially on the longitudinal axis of the band 5, the supporting point 7 is fixed level with the axis of rotation of drum 8. The rotatable member 8 comprises four arms 8*a* which extend along radii spaced 90°, each from the other. Each of these arms carries a wheel 8*b*, termed a "contact wheel" which is surrounded by an elastomer and is mounted to rotate freely.

Figure 5:
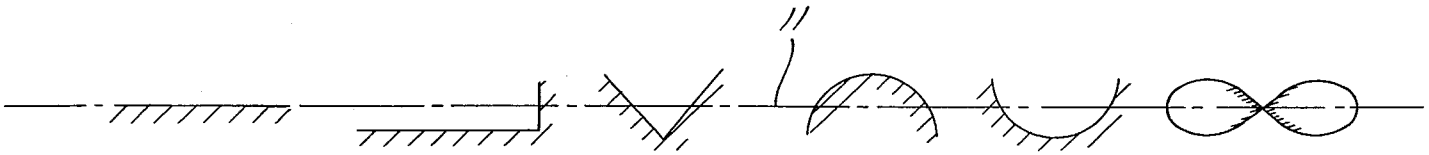
FIG. 5 illustrates different profiles of parts of objects to be polished in a single operation by the aid of the polisher of the invention.

The rotatable member 8 is splined on the shaft 8*c* which in turn is mounted on a tilting support 9, carried by the structure 1, and disposed horizontally and perpendicular to the shaft 8*c*. The rotatable member 8 is driven in rotation in such a way that it is possible to position one or the other of the contact wheels 8*b* before the smooth face of the abrasive band 5, and it also may be tilted toward the band so that the wheel 8*b* bears against the band and causes it to assume the shape of its profile. The contact wheel 8*b* is thus situated near the driven wheel 2*b*. It should be noted that this deformation should be realized without excessive tension of the band 5. FIG. 5 illustrates various forms of deformation of the band 5 when brought into contact with the said wheels 8*b*. It should be ensured in particular that the tangent line 11 connecting the wheels 2*b* and 4*a*, and coinciding with the driven length of the band 5 when the band 5 is not subjected to a contact with the object to be polished, divides the profile section of the contact wheel into two equal parts with the line 11 being parallel to the axis of rotation of the contact wheel.

The rotation and the tilting of the rotatable member 8 are obtained by means of a manual device, operated from the right of the machine. This device is composed of a circular plate 12, having a handle 12*a* to be taken hold of, the plate being mounted so as to be rotatable around an axle 12*b* and carried by an arm 9*c* integral with the support 9.

At its end opposite to that where the plate 12 is fastened, a pinion 13 is fastened. The axle 8*c* which carries the rotatable member 8 carries a sprocket wheel 14 at its end opposite the rotatable member 8. A chain 15 cooperates with the wheel 14 and the pinion 13.

The plate 12 is notched at its peripheral edge along a circular sector 12*c*, so as to be able to cooperate with a roller 16, in such a way that, when the roller 16 enters this notch, one of the contact wheels 8*b* is situated substantially at the axis of the band 5 and bears against this band with the pivoting of the support 9 being caused when the said roller 16 is in the notch 12. A tensile spring 17 tends to bear the plate 12 against the roller 16.

The rotatable member 8 is therefore rotated through the operation of the plate 12 after having disengaged the contact wheel 8*b* from the band 5 by an upward pull, so as to disconnect the plate 12 from the roller 16. During the rotation of the rotatable member 8, the plate 12 bears against the roller 16 at its peripheral edge.

In the event that it is desired to work on the band 5 without it bearing against one of the contact wheels 8*b*, the arms of the rotatable member are immobilized such that the arms are positioned in an X pattern relative to the machine at X, thereby clearing the work zone Z. Such immobilization may be accomplished, for example, by means of said roller 16 contacting a correspondingly positioned notch 12 in a manner as described above relative to the indexing of the contacting wheels.

To facilitate the mounting of the abrasive band 5, the drive wheel 4*a* has a dome-shaped protrusion 4*d* at one side.

The abrasive band 5 is slackened through the intermediary of a set of levers by opening the door 1*b*. The spring tends to hold the door closed. Dust and metal particles coming from the polishing operations are collected below the work zone Z by an inverted boot 1*c* so that dust carried along by the band 5 is routed toward the bottom of the machine by a conduit 18 running along the driven length of the band.

The boot and the conduit 18 end at a case 19. The vaned wheel is located inside the case 19 to form a suction fan.

The dust and metal particles 20 are thrown into a container 21, set in the lower rear part of the machine. A filter 21*a* permits evacuation of the air. The filter 21 is removable to permit periodic cleaning of the container 21.

It will be understood that various modifications may be made to the exemplary polisher and polishing method of this invention by a person skilled in the art without going outside the scope of the invention.

What is claimed is:

1. A polisher utilizing an abrasive band comprising:

a drive wheel adapted to be driven by a drive motor;

a freely rotatable driven wheel;

a freely rotatable contact wheel positionable for engagement with said band for altering the transverse contour of said band;

a support for said band spaced from said contact wheel so as to define a work zone which is at least in part between said contact wheel and said support having a width substantially equal to that of the band and being substantially unobstructed on either side of said band so as not to interfere with the orientation of the object being polished during the polishing operation; and wherein said support includes a portion engaging a non-abrasive side of said band which is approximately tangent to a point disposed on the path of the band between said driving and driven wheels so as to diminish deflections of the band during the polishing operation.

2. A polisher in accordance with claim 1 further including means for collection of dust such means comprising:

means for catching said dust, said means surrounding said belt and located below the working surface of said belt in such a manner as to not interfere with the orientation of the object being polished;

said drive motor provided with a suction fan to evacuate said dust; and means to direct said dust from said catching means to said suction fan.

3. A polisher in accordance with claim 2 wherein said means for collecting said dust further includes a bin located at a level below and behind said suction fan and a removable filtration means for allowing air to escape while retaining the dust so collected.

4. A polisher utilizing an abrasive band comprising:

a drive wheel adapted to be driven by a drive motor;

a freely rotatable drive wheel;

a support for said band having a width substantially equal to that of the band and being substantially unobstructed on either side of said band so as not to interfere with the orientation with the object being polished during a polishing operation;

wherein said support includes a portion engaging a non-abrasive side of said band which is approximately tangent to a point disposed on the path of the band between the said driving and driven wheels so as to diminish deflections of the band during a polishing operation; and said driven wheel is mounted to rotate freely and is articulated about an axis, the axis about which said driven wheel articulates being offset relatively to the axis of said wheel and substantially tangent with both the top and one side of said support, and means to control such articulation about said axis comprising a boss with an inclined surface which bears against a pointed element attached movably to said support means and means to adjust said pointed element longitudinally along its axis relative to said support means.

5. A polisher utilizing an abrasive band comprising:

a drive wheel adapted to be driven by a drive motor;

a freely rotatable driven wheel;

a support for said band having a width substantially equal to that of the band and being substantially unobstructed on either side of said band so as not to interfere with the orientation of the object being polished during a polishing operation;

wherein said support includes a portion engaging a non-abrasive side of said band which is approximately tangent to a point disposed on the path of the band between said driving and driven wheels so as to diminish deflections of the band during the polishing operation;

a rotatable member mounted to rotate about a shaft disposed on an axis passing approximately through the path of the band between said driving and driven wheels and disposed so as to be able to turn between said driving and driven wheels and between the band;

a plurality of freely rotatable contact wheels carried by said rotatable member;

said freely rotatable contact wheels mounted in such a manner that the axis of rotation of said wheels is disposed perpendicular to the axis of rotation of said rotatable member;

means for positioning respective ones of said contact wheels between the two non-abrasive facing sides of said band;

means for immobilizing said contact wheel in said position; and means for engaging said positioned contact wheel with the non-abrasive side of said band.

6. A polisher in accordance with claim 5 wherein said rotatable member includes four arms extending at 90° from one another with each of said arms carrying at least one of said contact wheels at its end, said contact wheels each having a determined profile and mounted to rotate freely about an axis perpendicular to the axis of said drum.

7. A polisher in accordance with claim 5 further including:

means for remotely turning the rotatable member; and means for remotely immobilizing the rotatable member in a position wherein a desired one of said contact wheels is located between the opposing non-abrasive sides of the band and in at least one additional position wherein none of said contact wheels are located between the opposing non-abrasive sides of said band.

8. A polisher utilizing a continuous abrasive band to be driven by a drive motor comprising:

a drive wheel for supporting and driving said band which is adapted to be driven by said drive motor;

a freely rotatable driven wheel for supporting said band in cooperation with said drive wheel disposed above and in line with said drive wheel thus forming an open loop in said abrasive band;

a rotatable member mounted about a shaft having an axis disposed in a plane passing approximately through the longitudinal axis of the band so as to rotate about said shaft axis and between said driving and driven wheels and inside of said open loop formed by said band;

a plurality of freely rotatable contact wheels carried by said rotatable member; and means for moving said rotatable member so that a respective one of said contact wheels moves from a position in which it does not bear against the band to a position in which it does bear against said band.

9. A polisher in accordance with claim 8 wherein at least one of said contact wheels has a configuration such as to cause the said band to conform to the shape of the work to be polished.

10. A polisher in accordance with claim 8 further comprising: means for remotely rotating said rotatable member so as to move one of said contact wheels out from a position inside of said loop of said band and move another of said contact wheels into said loop.

11. A polisher in accordance with claim 10 further comprising: means to remotely move one of said contact wheels from a position inside of said loop and not in contact with said band to a position inside of said loop and in contact with said band.

12. A polisher in accordance with claim 8 further comprising: means to remotely immobilize said rotatable member so that a selected one of said contact wheels is positioned inside of said loop and aligned with said band.

13. A polisher in accordance with claim 8 further comprising:

means to move one of said contact wheels out of engagement with said band;

means to rotate said rotatable member so as to move another of said contact wheels into said loop of said band;

means to move said another contact wheel from a position inside of said loop and not engaging said band to a position wherein said another contact wheel engages said band;

means to immobilize said rotatable member in a position such that a selected one of said contact wheels is positioned inside of said loop;

means to immobilize said rotatable member in at least one additional position such that none of said contact wheels are located inside of said loop; and said means to change position of said contact wheels are designed so as to allow said change of position while said band is being continuously driven.

14. A polisher utilizing a continuous abrasive band comprising:

a drive wheel adapted to be driven by a drive motor;

a freely rotatable driven wheel;

a support for said driving and said driven wheel;

a rotatable member mounted to rotate about a shaft disposed in a plane passing approximately through the longitudinal axis of the band and disposed so as to turn between said driving and driven wheels and between the facing non-abrasive sides of the band; and a plurality of freely rotatable contact wheels carried by said rotatable member and mounted to rotate freely in such a manner that the axis of rotation of said contact wheels is disposed perpendicular to the axis of rotation of said rotatable member.

* * * * *

UNITED STATES PATENT AND TRADEMARK OFFICE

CERTIFICATE OF CORRECTION

PATENT NO. : 3,972,152

DATED : August 3, 1976

INVENTOR(S) : ROBERT FAURE

It is certified that error appears in the above-identified patent and that said Letters Patent are hereby corrected as shown below:

Column 3, line 36, "drum" should be --rotatable member--.

Column 5, line 28, (Claim 4, line 3), "drive" should be --driven--.

Column 8, line 15, (Claim 14, line 9), before "turn", insert --be able to--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*